US007331905B1

(12) United States Patent
Wang

(10) Patent No.: US 7,331,905 B1
(45) Date of Patent: Feb. 19, 2008

(54) FIXED SAFETY HANDLE OF AN ELLIPTICAL CROSS TRAINER

(76) Inventor: Leao Wang, No. 1, Lane 233, Sec. 2, Charng Long Rd., Taiping (TW) 411

( * ) Notice: Subject to any disclaimer, the term of this patent is extended or adjusted under 35 U.S.C. 154(b) by 99 days.

(21) Appl. No.: 11/368,150

(22) Filed: Mar. 6, 2006

(51) Int. Cl.
*A63B 69/16* (2006.01)
*A63B 21/00* (2006.01)

(52) U.S. Cl. ..... 482/52; 482/57

(58) Field of Classification Search ..... 482/52, 482/57

See application file for complete search history.

(56) References Cited

U.S. PATENT DOCUMENTS 5,899,117 A * 5/1999 Newkirk ..... 74/551.8
6,672,992 B1 * 1/2004 Lo et al. ..... 482/52
6,758,790 B1 * 7/2004 Ellis ..... 482/52
D500,100 S * 12/2004 van der Meer ..... D21/662

* cited by examiner

*Primary Examiner*—Steve R Crow
(74) *Attorney, Agent, or Firm*—Troxell Law Office, PLLC

(57) ABSTRACT

A fixed safety handle of an elliptical cross trainer includes a fixed safety handle disposed near the top of a primary upright frame of an elliptical cross trainer, extended in direction of the operator, and bent in U-shape. The fixed safety handle includes a first holding member extending downwardly from both ends of the fixed safety handle and a second holding member extending laterally from the first holding member in direction to the outside such that the second holding member is located beyond the movement path of movable handles. In this way, the safety in getting on or stepping off the elliptical cross trainer can be ensured.

2 Claims, 3 Drawing Sheets

FIXED SAFETY HANDLE OF AN ELLIPTICAL CROSS TRAINER

BACKGROUND OF THE INVENTION

1. Fields of the Invention

The invention relates to a fixed safety handle of an elliptical cross trainer, and more particularly to a fixed safety handle of an elliptical cross trainer that allows a tight holding of a fixed safety handle without being influenced by the movable handles. Thus, the safety of the operator can be ensured.

2. Description of the Related Art

As shown in FIG. 4, the conventional elliptical cross trainer 10 includes a fixed safety handle 14 near the top of an upright frame 12 and two movable handles 18 that are disposed at both sides of the upright frame 12 and coupled with treadle planks 16. In this way, the operator can either hold the fixed safety handle 14 for keeping his balance or hold the movable handles 18 for a swinging movement of his both hands with the motion of his both feet.

Accordingly, as shown in FIG. 5, the movable handles 18 of the conventional elliptical cross trainer 10 usually move beyond the certain position of the fixed safety handle 14, and more particularly, in the position near the operator. Of course, there is no big problem in operation of the conventional elliptical cross trainer 10. However, safety risk arises when the operator gets on and steps off the treadles 19. The reason for that lies in that the movable handles 18 move as soon as a force is applied to the treadles 19 when the operator gets on the treadles 19. In this way, it's difficult for the operator to keep his balance at the moment of the swinging motion when the operator holds the movable handles 18 with his hand. Even, the operator can lose his balance and fall down to the ground. When the operator hold the fixed safety handle 14 with his hand, his hand may be injured by the strong impact of the movable handles 18. Similarly, the same trouble arises when the operator wants to step off the treadles after the exercise session.

SUMMARY OF THE INVENTION

Since the above-mentioned accident frequently occurs and denounced by the public, the inventor devoted himself to the improvement of the elliptical cross trainer such that the operator can use it without worrying about being injured. Thus, the safety in operation may be ensured. This is the primary object of the invention.

In order to achieve the above-mentioned object, a fixed safety handle of an elliptical cross trainer includes a fixed safety handle extended in direction of the operator. The fixed safety handle includes a first holding member extending downwardly from both ends of the fixed safety handle and a second holding member extending laterally from the first holding member in direction to the outside such that the second holding member is located beyond the movement path of movable handles. In this way, the safety in getting on or stepping off the elliptical cross trainer can be ensured

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 5:
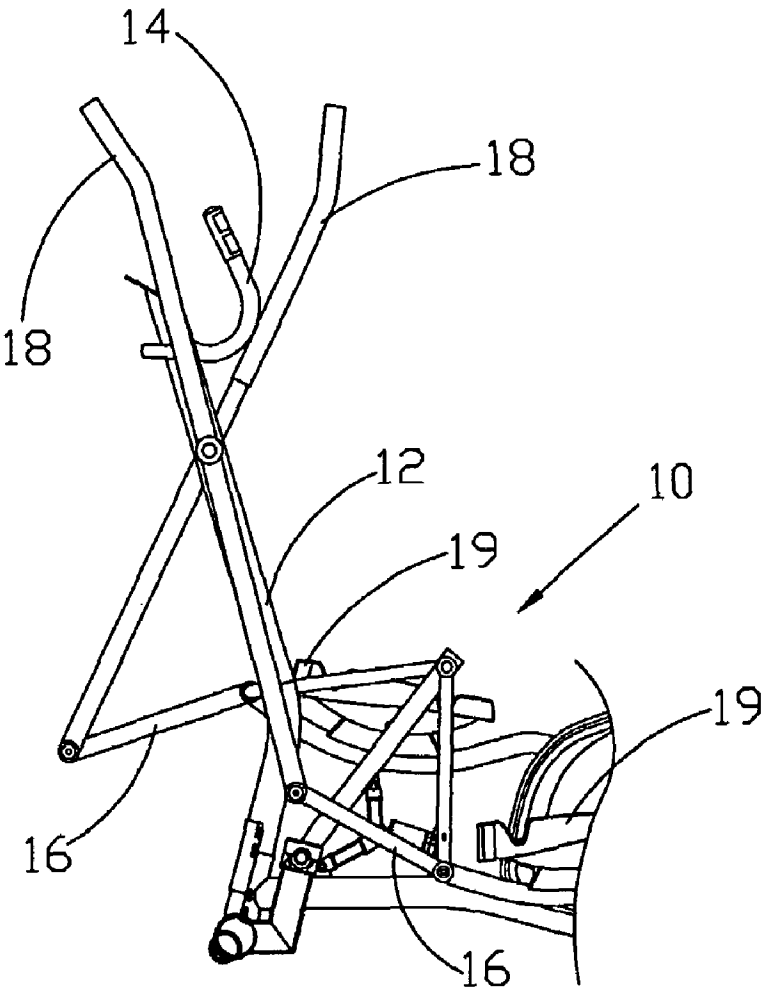
FIG. 5 is a side view of the conventional elliptical cross trainer in FIG. 4.
Figure 1:
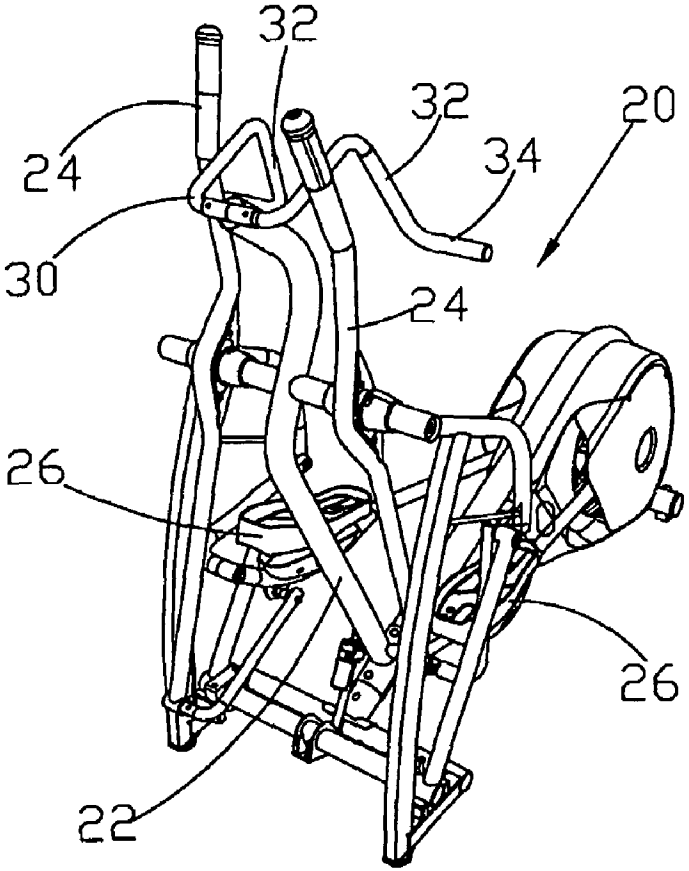
FIG. 1 is a perspective view of a preferred embodiment of the present invention.
Figure 2:
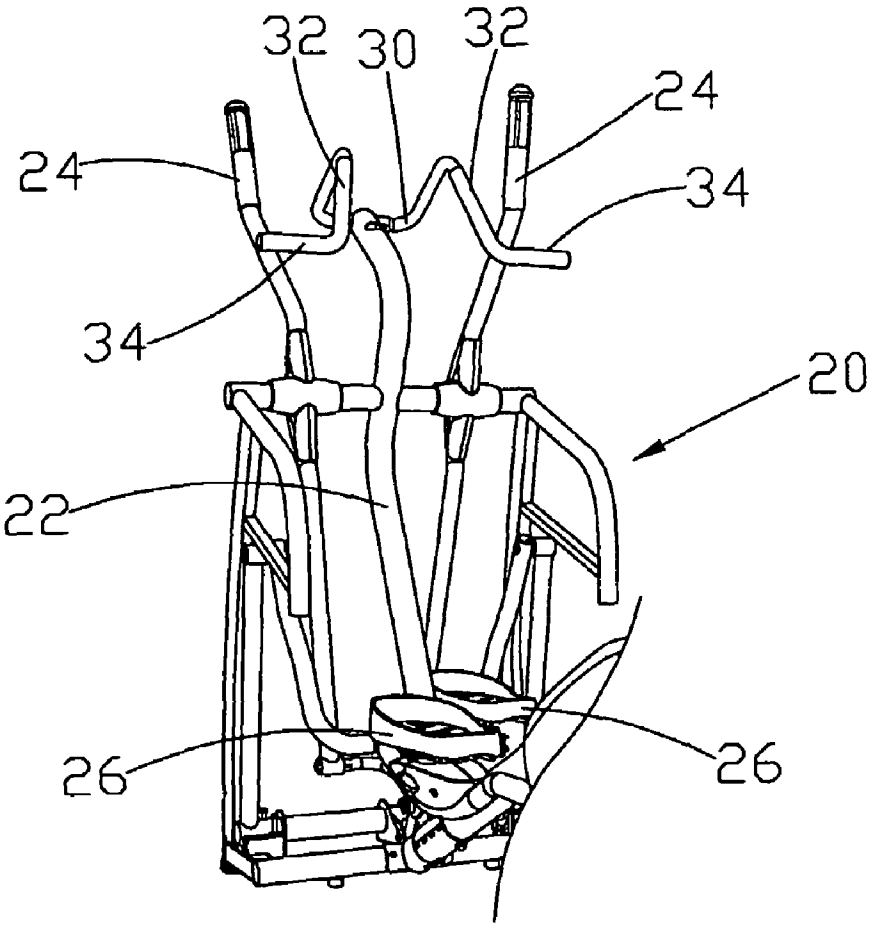
FIG. 2 is a perspective view of the preferred embodiment of the present invention seen from another side.
Figure 4:
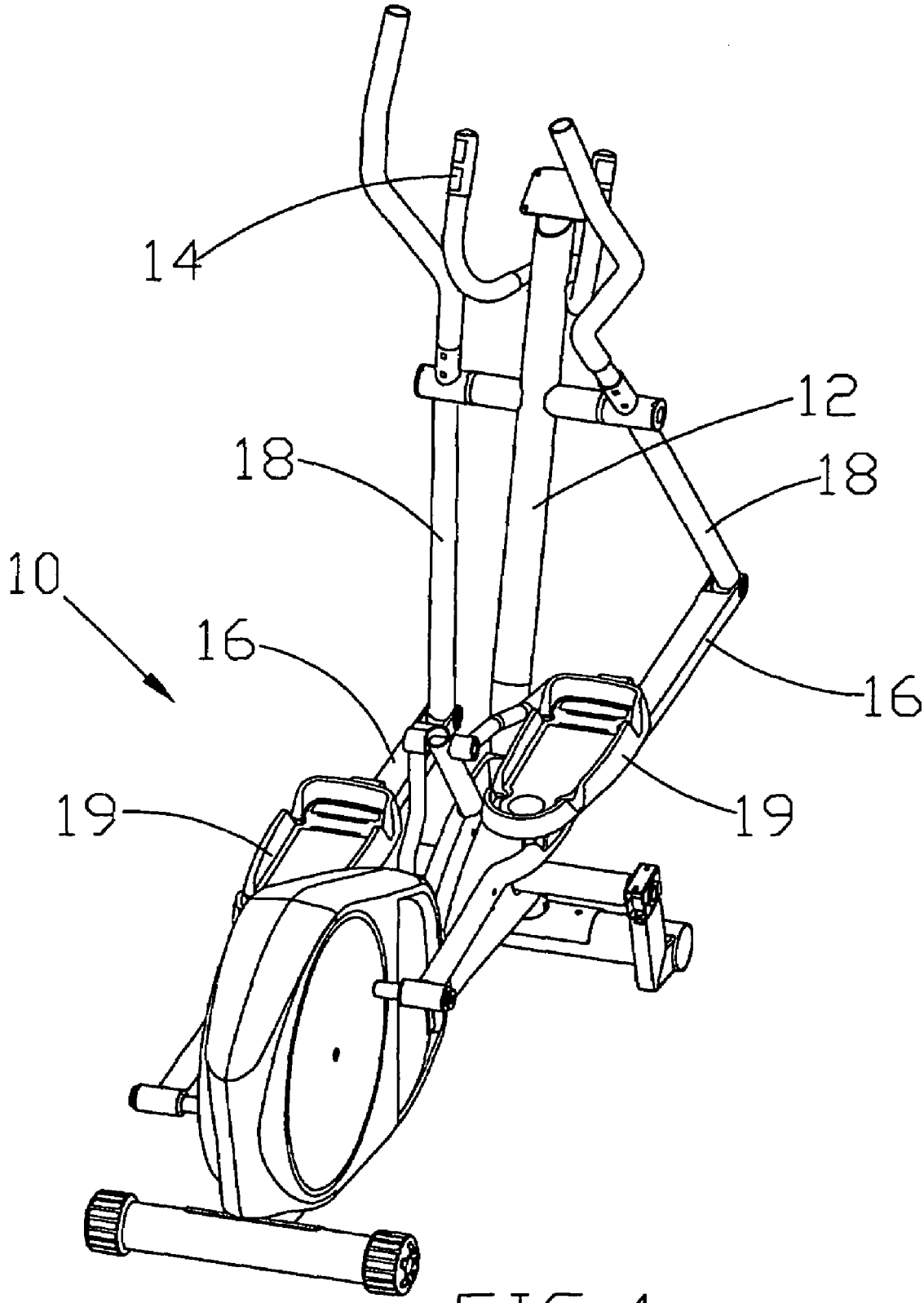
FIG. 4 is a perspective view of a conventional elliptical cross trainer.

First of all, referring to FIGS. 1 and 2, a preferred embodiment in accordance with the invention includes a fixed safety handle 30 disposed near the top of a primary upright frame 22 of an elliptical cross trainer 20, extended in direction of the operator, and bent in U-shape. The fixed safety handle 30 includes a first holding member 32 extending downwardly from both ends of the fixed safety handle 30 and a second holding member 34 extending laterally from the first holding member 32 in direction to the outside such that the second holding member 34 is located beyond the movement path of movable handles 24. In this way, the safety in getting on or stepping off the elliptical cross trainer 20 can be ensured.

Figure 3:
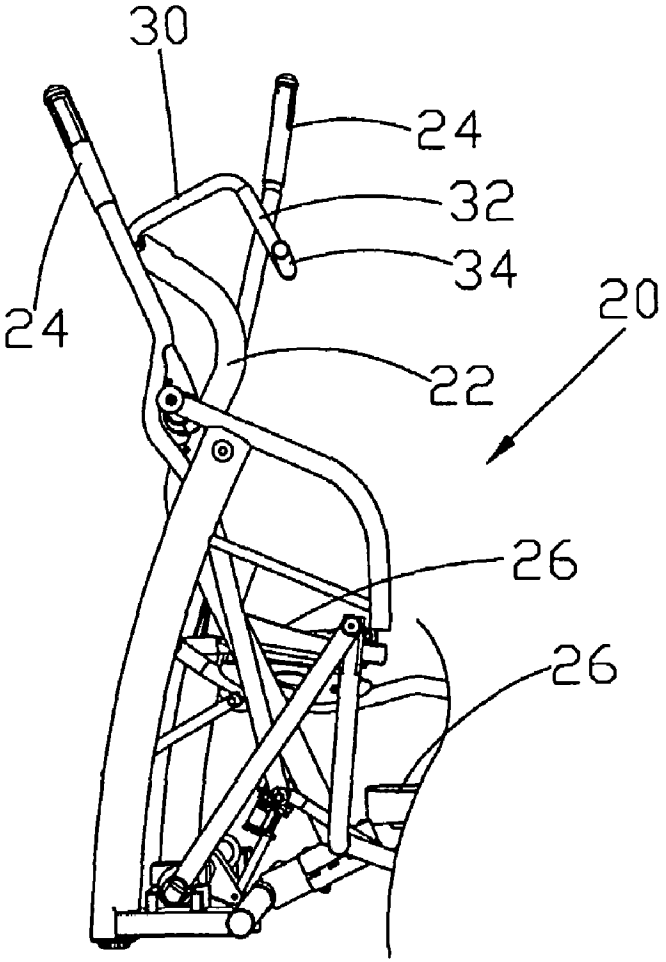
FIG. 3 is a side view of FIG. 1.

Based on the aforementioned configuration, as shown in FIG. 3, the movable handles 24 won't touch the second holding members 34 of the fixed safety handle 30 no matter how the movable handles 24 move and whether the operator gets on or steps off the treadles 26. Thus, the second holding members 34 can be firmly held in getting on or stepping off the elliptical cross trainer 20, thereby ensuring an expected safety effect.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claim.

What is claimed is:

1. In combination, an elliptical cross trainer and a fixed safety handle in combination with an elliptical cross trainer, comprising an elliptical cross trainer having movable handles and foot supports which travel in an elliptical path of motion, a fixed safety handle disposed near the top of a primary upright frame of the elliptical cross trainer, extended towards the operator, and bent in a U-shape, the fixed safety handle having a first holding member extending downwardly from both ends of the fixed safety handle and a second holding member extending laterally from the first holding member the outside such that, during operation, the second holding member is always located behind the movement path of movable handles in a position between the operator and the movable handles.

2. The fixed safety handle of claim 1, wherein the movable handles and the second holding member are positioned so that the movable handles never contact the second holding member during operation.

* * * * *